US006427395B1

(12) United States Patent
Elsasser et al.

(10) Patent No.: US 6,427,395 B1
(45) **Date of Patent: *Aug. 6, 2002**

(54) ELONGATED COVERING MEMBER OF EXTRUDED PLASTIC SUITABLE FOR FLOORING, DECKING, SEATING, AND LIKE USES

(75) Inventors: Glenn R. Elsasser; Frederic E. C. Wall, both of Winnipeg (CA)

(73) Assignee: Western Profiles Limited, Winnipeg (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/513,184

(22) Filed: Feb. 25, 2000

Related U.S. Application Data

(63) Continuation-in-part of application No. 09/174,450, filed on Oct. 19, 1998, now Pat. No. 6,044,598, which is a continuation-in-part of application No. 08/769,670, filed on Dec. 19, 1996, now Pat. No. 5,826,382.

(51) Int. Cl.[7] ..... E04F 5/10

(52) U.S. Cl. ..... 52/181; 52/8; 52/179; 52/403.1; 52/480; 52/650.3; 52/731.2; 52/732.1; 14/73; 114/84; 114/85; 114/263; 428/67; 428/167; 428/217; 405/4; 405/218

(58) Field of Search ..... 52/177, 181, 182, 52/188, 191, 403.1, 480, 483.1, 650.3, 731.1, 731.2, 732.1, 732.2; 14/73; 114/84, 85, 263, 266; 428/67, 163, 167, 212, 217; 119/28.5, 480; 404/19, 32, 33; 405/4, 218, 219

(56) References Cited

U.S. PATENT DOCUMENTS

| | | | | |
|---|---|---|---|---|
| 4,662,972 A | * | 5/1987 | Thompson | 156/279 |
| 4,840,824 A | | 6/1989 | Davis | |
| 4,905,431 A | * | 3/1990 | Davis | 52/179 |
| 4,998,391 A | | 3/1991 | Connew | |
| 5,009,045 A | | 4/1991 | Yoder | |
| 5,048,448 A | | 9/1991 | Yoder | |
| 5,070,664 A | | 12/1991 | Groh et al. | |

(List continued on next page.)

FOREIGN PATENT DOCUMENTS

| | | |
|---|---|---|
| CA | 989134 | 5/1976 |
| CA | 1190717 | 7/1985 |
| CA | 2100986 | 1/1995 |
| CA | 2108425 | 4/1995 |

*Primary Examiner*—Yvonne M. Horton
(74) *Attorney, Agent, or Firm*—Jones, Tullar & Cooper, PC

(57) ABSTRACT

An elongated member suitable for flooring, decking, or seating, having a top plate formed as an extrusion of plastic material, wherein the top plate includes ribs constituted by protruding parts of parallel, spaced, elongated friction elements co-extruded therewith, the friction elements being formed of plastic having distinctly greater softness or flexibility than the main parts of the top plate and suitable for providing a non-slip surface. The member may include an elongated support formed as a relatively rigid extrusion of plastic material having a base plate with upstanding side walls and a central support portion, the top plate overlying the support and having edge formations engaging the side walls. Alternatively, the top plate and support may be formed integrally by extrusion, or the top plate may be part of a plank cover having integrally formed ribs for spacing the top plate above a plank.

12 Claims, 3 Drawing Sheets

U.S. PATENT DOCUMENTS 5,103,608 A * 4/1992 Andreo ..... 52/179
5,148,644 A * 9/1992 Weir ..... 52/300
5,190,799 A * 3/1993 Ellingson, III ..... 428/53
5,553,427 A * 9/1996 Andres ..... 52/177
5,587,218 A * 12/1996 Betz ..... 428/67
5,613,339 A 3/1997 Pollock
5,642,592 A * 7/1997 Andres ..... 52/177
5,647,184 A 7/1997 Davis
5,758,467 A 6/1998 Snear et al.
5,787,655 A * 8/1998 Saylor, Jr. ..... 52/181
5,816,010 A * 10/1998 Conn ..... 52/588.1
5,826,382 A * 10/1998 Elsasser et al. ..... 52/181
5,904,011 A * 5/1999 Biro ..... 52/177
6,018,925 A * 2/2000 Biro ..... 52/731.1
6,044,598 A * 4/2000 Elasser et al. ..... 52/181
6,101,770 A * 8/2000 Dalton ..... 52/179
6,112,479 A * 9/2000 Andres ..... 52/177
6,170,212 B1 * 1/2001 Suchyna et al. ..... 52/480

* cited by examiner

ELONGATED COVERING MEMBER OF EXTRUDED PLASTIC SUITABLE FOR FLOORING, DECKING, SEATING, AND LIKE USES

CROSS-REFERENCE TO RELATED APPLICATION

This application is a continuation-in-part of U.S. Ser. No. 09/174,450, filed Oct. 19, 1998, now issued as U.S. Pat. No. 6,044,598, which is itself a continuation-in-part of U.S. Ser. No. 08/769,670, filed Dec. 19, 1996, now issued as U.S. Pat. No. 5,826,382 dated Oct. 27, 1998.

BACKGROUND OF THE INVENTION

1. Field of the Invention

The present invention relates to an elongated member made entirely or partially of extruded plastic, and suitable for use as the upper surface of decks, docks, or bench type seating, and for other uses, generally in walking, standing, or sitting areas. One form of the invention is a covering member for wooden, metal, or concrete planks or beams.

2. Prior Art

There have been various prior proposals for using plastic extrusions for decking and like flooring needs, and for seating, especially for outdoor use, and our above-mentioned patent and application provide extrusions for such uses. Examples of such constructions are described in the following patents:

Canadian Patent No. 989,134, issued May 18, 1976 to Hassman;

Canadian Patent No. 1,190,717, issued Jul. 23, 1985, to Stanley et al.;

Canadian Patent Application No. 2,100,986, published Jan. 22, 1995, of Steadman; and Canadian Patent Application No. 2,108,425, published Apr. 15, 1995, of Bayly.

The Canadian patents of Hassman and Stanley et al., and the Steadman application, describe structures formed of polyester resin or like material with glass fiber reinforcement, these structures being formed by pultrusion. The Bayly application describes a plastic channel type member, which seemingly might be extruded, although this does not appear to be mentioned.

It has also been proposed to provide existing wooden, metal, or concrete planks or beams with a cover formed from a plastic extrusion. Covering such a plank with plastic may be desirable, for example, to protect existing wood or to cover wood which has become deteriorated or likely to produce splinters, or for improving the comfort or appearance of a concrete or metal beam. Examples of such plastic extrusions are described in the following patents:

U.S. Pat. No. 5,070,664, which issued Dec. 10, 1991 to Groh. et al., and which describes an extruded plastic structure for fitting onto wooden or steel benches to improve comfort and weather resistance; and U.S. Pat. No. 5,904,011, which issued May 18, 1999 to Biro, and which describes an extrusion suitable for boat docks and residential decks.

In addition, U.S. Pat. No. 4,840,824 to Davis, and U.S. Pat. No. 4,998,391 to Connew, describe plastic extrusions which may be used as stairtreads.

A common drawback of plastic surfaces for decks and other walking areas is that these tend to be slippery, especially when wet. Some of the prior patents show ribs or other formations intended to provide a non-slip surface. Others have a grit surface or a textured surface.

The Groh et al. patent shows a structure with an overlying cap or "capstock" of between 15 and 25 mils in thickness, formed of a rigid vinyl resin, intended to improve weatherability, and which also has spaced apart, integrally formed, parallel ridges which provide a gripping surface. The Biro patent shows longitudinal upstanding ribs which are extruded, and which are subsequently embossed to form the ribs into pyramid-shaped tread members.

These prior art non-skid features are believed to have some drawbacks. Thus, ribs of the type shown in the Hassman or Groh et al. patents provide little gripping effect in directions parallel to the ribs. In each case, the ribs are formed integrally with the surrounding material and thus have the same hardness or firmness. The actual decking made in accordance with the Groh et al. patent, including the ribs, has a hard surface and lacks friction in the direction of the ribs; tests discussed below give a comparison of the friction achieved with Groh et al. compared to material made in accordance with this invention. Surfaces of the kind described in the Stanley et al patent, or in the Bayly application, are likely to be difficult to produce as part of an extrusion process.

The non-slip features shown by Biro and Connew require additional manufacturing steps beyond a simple extrusion process.

The stairtread products of Davis and Connew use, as anti-slip elements, upwardly projecting rib members which are of softer material than the main body of the stairtread. Where these are recessed into the main body of the stairtread these would weaken the product; however this is unimportant for a stairtread since the main plate portions of the stairtreads are fully supported by the underlying surface.

In Biro, the extrusion has a top plate which is separated by depending ribs or spacer means from the surface, for example the plank, which it covers. The spacer means include channels which receive fasteners and which accommodate covers over the fasteners. The top plate therefore requires some bending strength where it bridges gaps between these spacer means. Accordingly, unlike with the stairtread patents, the top plate does require some strength.

There exists a need for a cover for flooring or decking member, seating member or the like, which can easily be produced by extrusion, preferably without subsequent steps being performed, and which has a non-skid feature which is effective lengthwise of the member and not only in the cross direction. The non-skid feature should also not unduly weaken the top plate.

SUMMARY OF THE INVENTION

The present invention provides an elongated member suitable for flooring, decking, or seating, comprising top plate means overlying spacer means suitable for spacing the top plate means above the top surface of the support, the top plate means bridging gaps between the spacer means, both the top plate means and the support being formed by extrusion of plastic material. To overcome the slippery nature of the basic structure, the top plate means has a non-slip surface provided by ribs constituted by portions of parallel, spaced apart, elongated friction elements co-extruded with a main component of the top plate, these elements being formed from plastic material having distinctly greater softness or flexibility than that of the main component which lies between and underneath the friction elements. These elements have their lower portions embedded in the top plate means. However since the top plate means must resist bending, the elements are made so as not to penetrate more than one half the top plate depth, and in some embodiments penetrate only 35% or 25% of the top plate depth.

The ribs in accordance with this invention have a hardness between 50 and 92 Durometer in the Shore A scale, and preferably less than 90 Durometer, and in some cases less than 80 Durometer on the Shore A scale. The softness of the ribs in accordance with this invention is comparable to that of treads on shoes, and gives the ribs enhanced friction in the longitudinal direction, as well as in the transverse direction.

In the preferred embodiments, the friction elements have a hardness of between 75 and 85 Durometer on the Shore A scale, while the main component of the top plate means has a hardness of at least 70 Durometer on the Shore A scale.

Preferably, the ribs protrude from the top plate between 0.02 and 0.05 inches (0.5 to 0.13 mm). The ribs may be integral with a capstock layer which forms part of the top plate means and totally covers the main component.

One embodiment of the invention, which is the subject of our aforesaid copending application, is an all plastic, all extruded, elongated member, for example a hollow flooring member, comprising a top plate means as described overlying a lower support part also formed as an extrusion of plastic material and having a base plate with upstanding side walls and upstanding, longitudinally extending support webs positioned between the side walls, the top plate means bridging gaps between the side walls and webs.

In another embodiment, which is the subject of the issued U.S. Pat. No. 5,826,382 as aforesaid, the top plate means may be formed separately from the support part, and may have inturned edge elements held by interengaging formations at the top of the side walls of the support part.

The present application however is particularity concerned with a form of the invention which is a cover for a support such as a plank or beam of wood, metal, or concrete, in which the spacer means, which are integrally extruded with the top plate means, include two spaced channels having bottom webs suitable for lying on the support top surface and for receiving fasteners to secure the member to the support.

BRIEF DESCRIPTION OF THE DRAWINGS

Preferred embodiments of the invention will now be described by way of example with reference to the accompanying drawings, in which.

DETAILED DESCRIPTION

Figure 1:
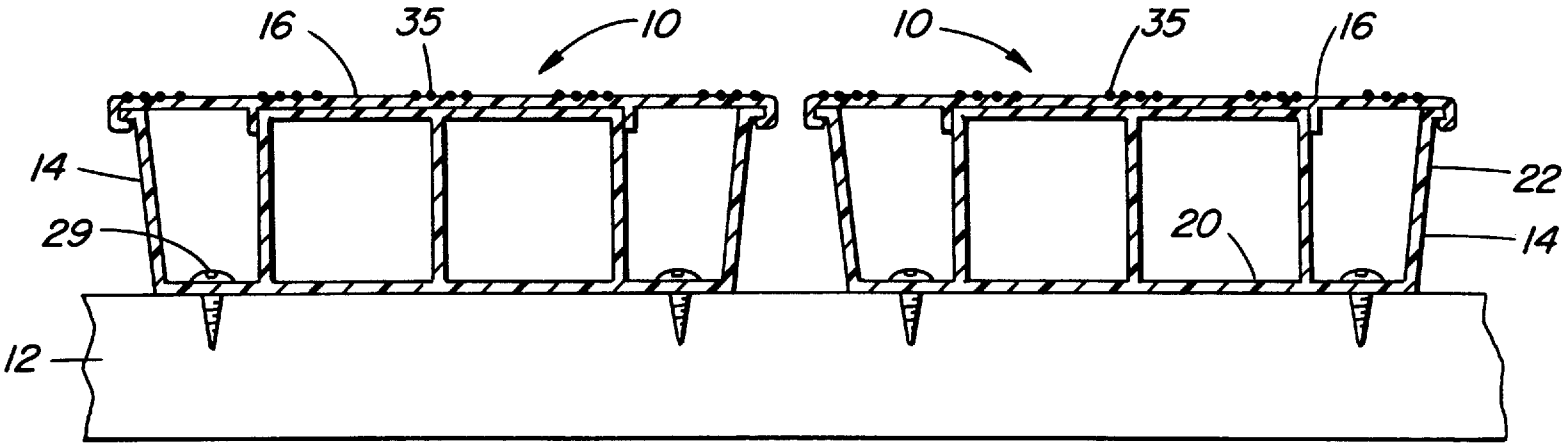
FIG. 1 is a cross-sectional view through a portion of a deck using flooring members according to the invention of the aforesaid issued U.S. Pat. No. 5,826,382.

In FIG. 1 two elongated members 10 in accordance with this invention are shown supported on a wooden joist 12. Each member is made of two parts, shown separately in FIGS. 4 and 5. These parts include a support part 14, shown in FIG. 5, and a top plate part 16 shown in FIG. 4. Each of these parts is integrally formed by extrusion, and the whole of the support part, and most of the top plate, are formed of rigid PVC (polyvinyl chloride). The width of each part is between 5 and 6 inches, and the wall thickness of each is about 0.1 inches or 2.5 mm.

The support part 14 has a base plate 20 with a flat underside and upstanding side walls 22, and upper edges of the walls have outwardly projecting lips 22*a*. A central region of the support part has an upstanding support portion 24 extending longitudinally of the member, this having a height almost the same as that of the walls. The support portion has two outer upstanding support webs 26 and a central upstanding support web 27, these webs being bridged by a roof member 28, providing an upper support surface. The side walls and webs provide spacer means holding the top plate part 16 spaced above the supporting joist 12, while the flat underside of the base plate 20 allows the member to rest in stable manner on the flat upper surface of the joist.

The base plate 20 is fastened to the joists 12 by screws 29 which penetrate the base plate and which are accessible between the walls 22 and the outer webs 26. Afterwards, the top plate 16 is applied.

Figure 4:
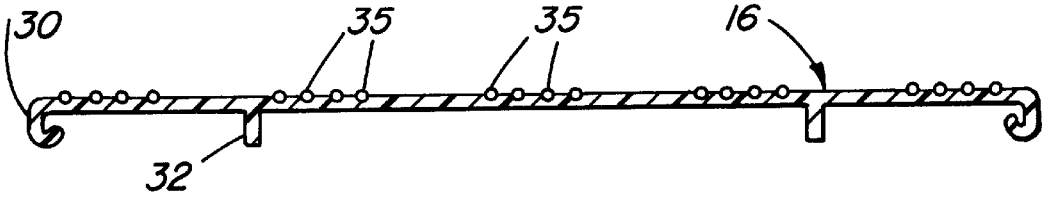
FIGS. 4 and 5 are enlarged sectional views of the main components of the flooring member.
Figure 5:
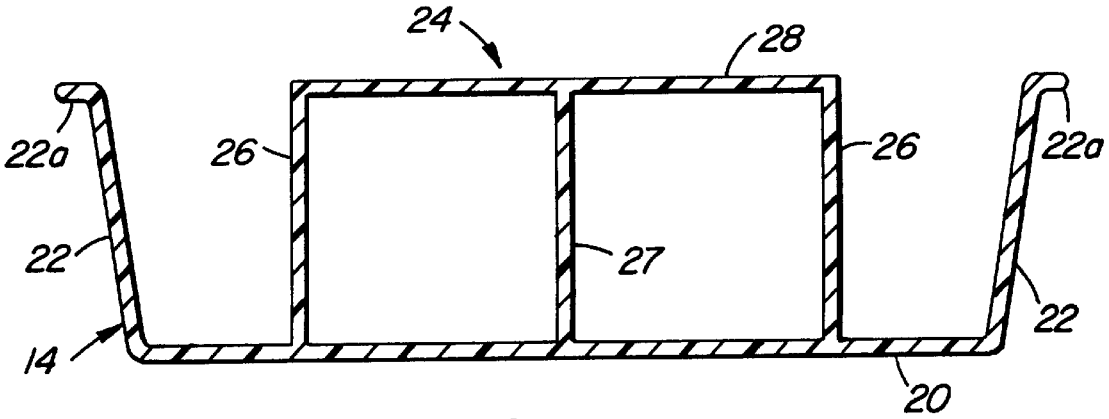

The top plate part, shown in FIG. 4, is generally flat, except for inturned side edge elements 30 providing inwards facing grooves shaped to be a snap fit onto the lips 22*a* of the side walls 22 of the support part, and depending ribs 32 which locate against the upper margins of the webs 26. The top plate and support part can be snap fitted together, without any holding means being required, the top plate being removable by use of a suitable tool. Although the top plate is formed of similar rigid PVC as the support part, since it is largely flat it is capable of being bent longitudinally, and can be supplied in roll form; alternatively it can be supplied in pre-cut lengths. The top plate needs to be made of a plastic composition which is highly resistant to weathering.

In accordance with this invention, the top plate 16 is provided with ribs constituted by upper portions of rod-like parallel elongated friction elements 35 which protrude from the upper surface of the main component of the top plate, having their lower portions embedded in this main component, the main component lying between and underneath these elements. These friction elements have a roughly circular cross-section of between 0.04 and 0.10 inches diameter, and about half the cross-section of each of these elements, usually about 0.02 to 0.05 inches, protrudes above the generally flat upper surface of the top plate to provide a non-skid surface. Each top plate has five groups of these friction elements, each group comprising four such elements spaced between 0.1 and 0.15 inches apart. Elements 35 are also formed of plastic, and are co-extruded with the main component of the top plate. These elements 35 are however of flexible PVC; i.e. they are formed of PVC having considerably more plasticiser than that of the rigid PVC which forms the main component of the top plate and which is normally exposed between these elements, and have distinctly greater flexibility. In practice, the hardness of the flexible plastic forming the friction elements 35 will be between 50 and 92 Durometer hardness on the Shore A scale, and preferably between 55 and 90, and most preferably between 75 and 85 on this scale. By comparison, the rigid PVC of the remainder of the top plate has a hardness of between 70 and 90 on the Shore D scale. Measurements of 54 or more on the D scale all relate to hardnesses greater than 95 on the A scale. These figures are for instantaneous hardness as tested according to ASTM D2240. The flexible PVC is similar to material used to produce treads of shoe soles, and has sufficient friction that it has a non-skid effect in the longitudinal direction of the flooring member, as well as in the transverse direction.

Figure 3:
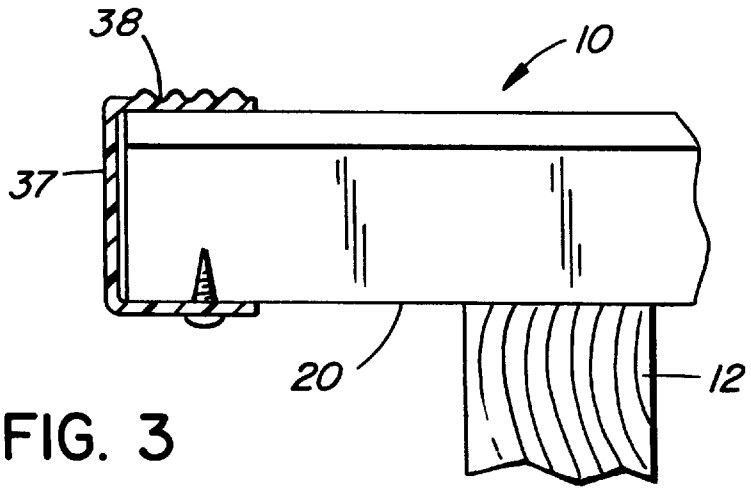
FIG. 3 is a partial longitudinal section of the end of a flooring member.

After the supports described have been fixed to the joists 12 and assembled with their top plates, the ends are closed by channel members 37 shown in FIG. 3. These channel members, which are also of extruded plastic material, have upper and lower flanges which enclose the upper and lower margins of the ends of the flooring members. The lower flanges are fastened to the base plate 20 by screws. The upper flanges 38 have small longitudinal ribs which also provide a non-skid feature.

Tests have been done to show that the product made in accordance with this invention exhibits substantially more friction than the prior art Groh et al. type product made in accordance with U.S. Pat. No. 5,070,664. The results of these tests are shown on the Tables 1 and 2 set out below. These tests were carried out by the Industrial Technology Centre, of Niakwa Road East, Winnipeg, Manitoba, Canada; this is an agency of the Government of Manitoba, Dept. of Industry, Trade and Tourism. The tests were conducted using the ASTM C1028 test method of the American Society for Testing and Materials, entitled:

"Standard test Method for Determining the Static Coefficient of Friction of Ceramic Tile and Other Like Surfaces by the Horizontal Dynamometer Pull-Meter Method".

The procedure for the tests involves the use of a heel assembly of suitable material, such as "Neolite" rubber, which is loaded with a 50 pound (22 Kg) weight and pulled along a flooring surface being tested. The static friction is determined by measuring the pull needed to move the heel assembly with a horizontal pull meter, and is done at mutually perpendicular angles, and in both wet and dry conditions. To obtain the coefficient of friction (COF), the average pull force for each condition is divided by the weight being used plus the weight of the heel assembly, and a calibration factor is added. In the tests done on Applicant's "Trac-decking" product, and the Groh. et al. type product shown in the Tables as "Grey decking", two series of tests were done, the first (Table 1) with rubber, and a second (Table 2) with leather. The results are as shown in the following tables:

TABLE 1

Coefficient of Friction Test (Rubber)

| SAMPLE DESCRIPTION | TEST DIRECTION | TEST NO. | | RUBBER DRY | RUBBER WET |
|---|---|---|---|---|---|
| "TRAC-DECKING" | Parallel | 1 | Pull | 45.5 | 43.0 |
| | | 2 | Force | 45.5 | 47.0 |
| | Perpendicular | 1 | in lbs. | 46.5 | 55.0 |
| | | 2 | | 45.0 | 58.0 |
| | | COF | | 0.79 | 0.93 |
| GREY DECKING | Parallel | 1 | Pull | 34.0 | 39.0 |
| | | 2 | force | 31.0 | 38.5 |
| | Perpendicular | 1 | in lbs. | 41.5 | 41.0 |
| | | 2 | | 39.5 | 42.0 |
| | | COF | | 0.61 | 0.72 |

TABLE 2

Coefficient of Friction Test (Leather)

| SAMPLE DESCRIPTION | TEST DESCRIPTION | TEST NO. | | LEATHER DRY | LEATHER WET |
|---|---|---|---|---|---|
| "TRAC-DECKING" | Parallel | 1 | Pull | 39.0 | 40.0 |
| | | 2 | Force | 34.5 | 40.0 |
| | Perpendicular | 1 | ins. | 38.5 | 42.5 |
| | | 2 | lbs. | 36.5 | 42.5 |
| | COF | | | 1.06 | 0.73 |
| GREY DECKING | Parallel | 1 | Force | 15.0 | 30.0 |
| | | 2 | in | 11.5 | 28.0 |
| | Perpendicular | 1 | lbs. | 16.5 | 37.5 |
| | | 2 | | 15.0 | 38.0 |
| | COF | | | 0.62 | 0.58 |

Tables 1 and 2 and show that coefficient of friction for Applicants' product, when used with rubber (Table 1), is 0.79 and when dry and 0.93 when wet. The comparable friction coefficients for the Groh et al. type product ("Grey decking") are 0.61 and 0.72. While this is a useful increase infriction, more pronounced differences are noted with leather, as shown in Table 2. Here, the coefficients obtained with the Applicants' "Trac-decking", dry and wet, are 1.06 and 0.73 respectively, while the coefficients obtained for the "Grey decking" are 0.62 and 0.58, dry and wet respectively. It will further be noted from Table 2 that the results for the "parallel" direction, i.e. along the ribs, was very low for the dry "Grey decking", considerably less than one half that achieved with the "Trac-decking". The very low friction of the "Grey decking" shown here would be slippery to anyone walking in leather shoes on this kind of decking. Also, Table 2 shows that even in the case of the dry "perpendicular" pull with the "Grey decking", the coefficient of friction, while higher than in the "parallel" direction, is always less than one half the minimum friction achieved in any of the tests with Applicant's "Trac-decking". These tests indicate that Applicants' "Trac-decking" is considerably less slippery than a typical prior art decking of extruded plastic material.

Variations are of course possible in the particular dimensions and material to be used. The elongated friction elements 35 may be of different cross-sectional size and shape, for example they may be square or diamond shape in cross-section. What is important is that a proportion of these elements projects above the surface of the top plate by at least 0.02 inches (0.5 mm), and amounts of projection up to 0.05 inches (1.3 mm) may be used. In order not unduly to weaken the top plate where it bridges the gaps between the side flange 22 and the bridge part 24, the friction elements will not penetrate into this more than one half its depth, so that at least 0.05 inches (1.3 mm) of top plate remains below the ribs. It is not necessary that PVC be used for the top plate and/or friction elements, and the same effect can for example be achieved with ABS plastics, using a small proportion of plasticiser in the main part of the member and more in the elements 35 so that these are of flexible ABS plastic. It is also possible to form the top plate so that it has a thin capstock, of say 0.004 to 0.010 inch thickness, of weatherable plastic having good color uniformity, overlying a base layer of cheaper recycled material.

Figure 6:
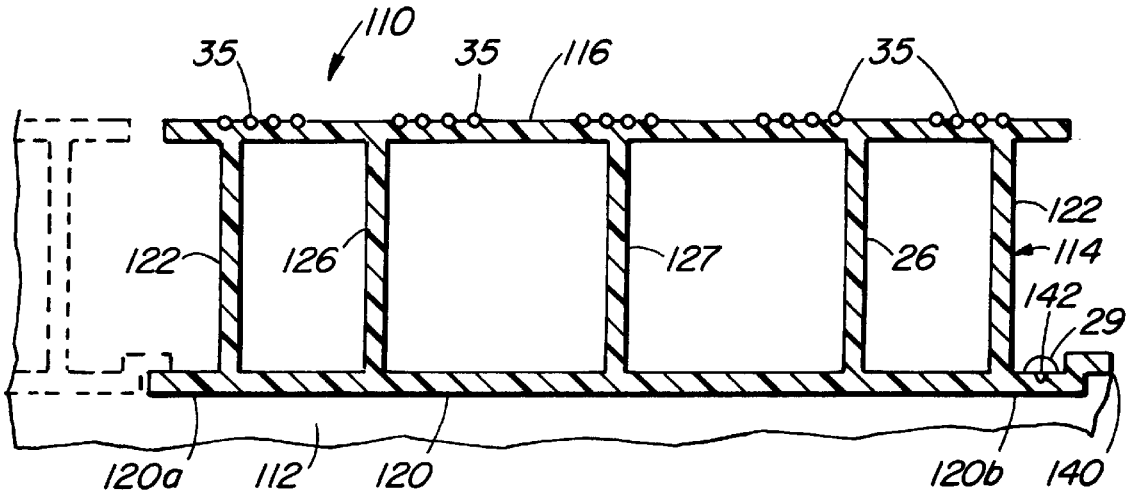
FIG. 6 is a cross-sectional view of a second embodiment of the invention.

FIG. 6 shows a further embodiment of the invention which is integrally extruded from plastics material as a single hollow member, instead of being formed of several parts.

The member 110 of FIG. 6 has a lower support part 114 comprising a flat base plate 120 suitable for lying on a flat wooden support or joist 112 corresponding to joist 12 of the first embodiment. The member has upstanding, substantially vertical side walls 122, between which are located upstanding, substantially vertical support webs 126 and 127, at locations corresponding to those of webs 26 and 27 of the first embodiment. Here, the walls and webs are integral with the top plate part 116, and constitute spacer means holding the top plate part spaced above the support 112. As in the first embodiment, the top plate part has ribs formed by protruding portions of parallel spaced apart friction elements 35, which are formed of plastic having distinctly greater softness or flexibility than the main component of the top plate. The softness of these elements, and the hardness of the surrounding main component of the top plate, are similar to those of the first embodiment.

In this embodiment the top plate provides the only bridge part between the webs 126 and 127, and accordingly the top plate is significantly stressed in bending and it is important that the friction elements are arranged so as not to unduly weaken the top plate. Preferably, they occupy less than 50% of the thickness of the top plate, and most preferably less than 35% or 25% the thickness of the top plate. Since the top plate needs more strength than in previous embodiments, the thickness of this is preferably at least 0.12 inches or 3 mm, and the friction elements are arranged so that the top plate plastic under the elements is at least 0.07 inches (1.8 mm) in depth, and preferably at least 0.08 or 0.09 inches (2 mm or 2.3 mm) in depth.

The base plate 120 has side extensions 120*a*, 120*b*, which project beyond the lower edges of the side walls 122. These are assist in locating the members accurately side-by-side, and also serve an additional purpose, namely in providing convenient means for securing the member to a supporting joist. One of the extensions 120*b* has a groove 142 which provides a location for screws 29 used to fasten the member to a joist. The outer edge of the same extension 120*b* has a raised lip formation 140 which operates to provide a recess capable of receiving an edge of side extension 120*a* of an adjacent identical member.

The top plate part 116 and lower support part 114 may be coextruded of different materials, with sun and weather resistant material being used for the top plate part and cheaper material being used in the support part.

Figures 7, 7A:
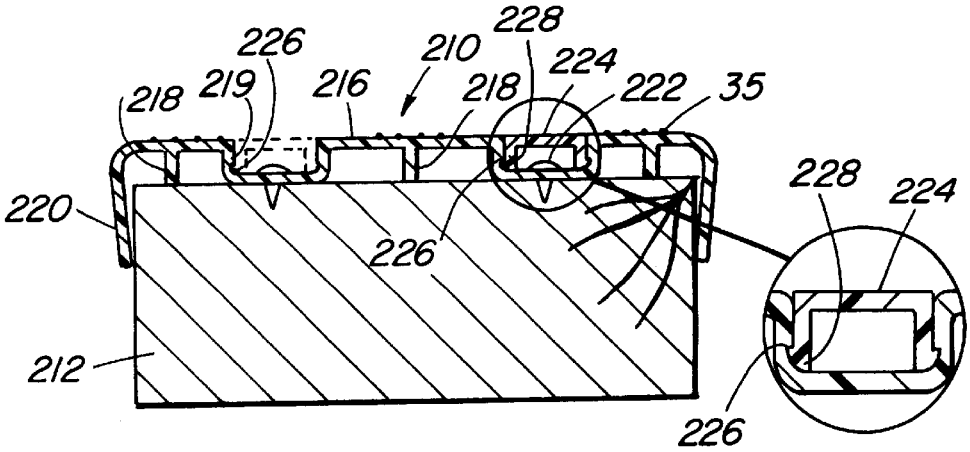
FIG. 7 is a cross-sectional view of a third embodiment of the invention, in the form of a wooden plank cover.
FIG. 7*a* is a detail view of a part of the FIG. 7 plank cover.

In FIG. 7 an elongated plank covering member 210 in accordance with this invention is shown covering the top portion of a wooden beam 212. The beam 212 may be an old beam which has deteriorated and which is of unsatisfactory appearance, or it may be a new beam which needs protecting by the cover.

The member 210 has a main top plate part 216 which is spaced above the flat top of the beam 212 by spacer means including depending ribs 18 and a pair of spaced channels 219; the bottom surfaces of the ribs 218 and the channels 219 are co-planar so that the member can rest in stable manner on the flat top of the beam 212. These spacer means provide for ventilation between the covering member and the beam and inhibit rotting of the beam. In this embodiment, one spacer rib is provided between the two channels, and a further rib is provided on the outer side of each channel. At each edge is a depending flange 220 which is deeper than the ribs and channels so as to extend down the outer edges of the beam and to enclose the upper portions of these edges. These parts are integrally formed by extrusion, and ribs, channels, and a main component of the top plate are formed of rigid PVC (polyvinyl chloride), preferably having a hardness of at least 70 Durometer on the Shore D scale, and which is resistant to weathering. Its wall thickness is 0.06 inches (1.5 mm). The width of the beam covered by the cover member is about 3.5 inches.

The covering member is fastened to the beam 212 by screws 222 which penetrate the bottom portion of the channel 219. After the screws 222 are put in place, each channel is adapted to be closed by a cover strip 224 also of extruded plastic material; in FIG. 7 one of these strip is shown in place and the other is shown in broken lines. Each channel has, on its opposite inner, lower side surfaces, a pair of opposed recesses 226 each terminating in a downwardly facing land or lip, and these recesses accommodate outwardly projecting claw elements 228 along the lower edges of the cover strips and which are of complementary shape to the recesses so that upper surfaces of the claw elements can engage the downwardly facing land or lip. Accordingly, the cover strips 224 can simply be pushed and snapped into place when the screws 222 have been put in place; they are also capable of being removed by pry means when necessary.

As in the previous embodiments, the top plate 216 is provided with ribs constituted by upper portions of rod-like parallel elongated friction elements 35 which protrude from the upper surface of the main component of the top plate, having their lower portions embedded in this main component, the mai component lying between and underneath these elements. These friction elements, and the thickness of the top plate, are generally similar to those of the first embodiment. Thus the friction elements have a roughly circular cross-section of between 0.04 and 0.10 inches diameter, and about half the cross-section of each of these elements, usually about 0.02 to 0.05 inches, and preferably about 0.03 inches, protrudes above the generally flat upper surface of the top plate to provide a non-skid surface. The lower portions of the friction elements penetrate into the top plate no more than one half the top plate depth. Each top plate has three groups of these friction elements, each group comprising four such elements spaced between 0.1 and 0.15 inches apart. Elements 35 are also formed of plastic, and are co-extruded with the main component of the top plate. These elements 35 are however of flexible PVC; i.e. they are formed of PVC having considerably more plasticiser than that of the rigid PVC which forms the main component of the top plate and which is normally exposed between these elements, and have distinctly greater flexibility. The softness/hardness characteristics may be the same as, or similar to, those of the previous embodiment.

Figure 8:
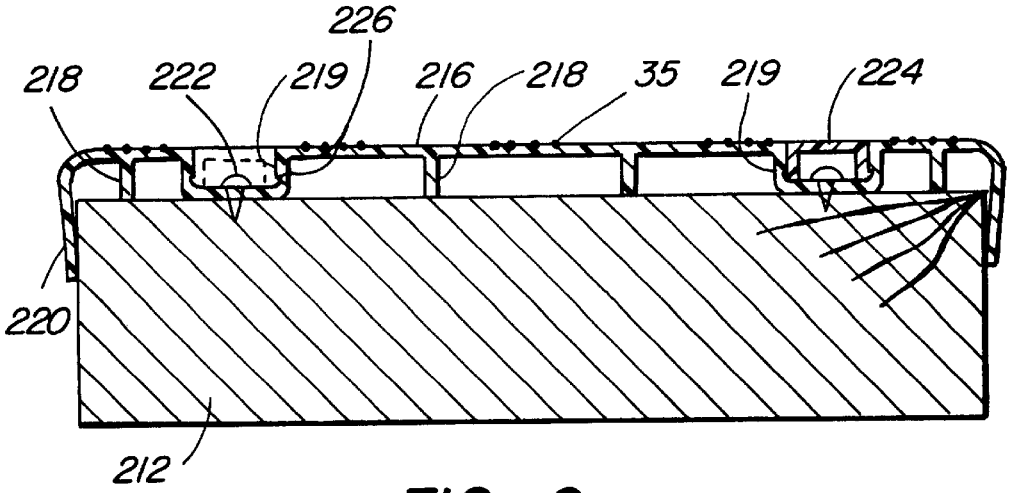
FIG. 8 is a cross-sectional view through a variation of the plank cover.

The embodiment shown in FIG. 8 is closely similar to that of FIG. 7, except in being wider, so as to cover a plank of about 5½ inches. It has two central depending ribs 218, and instead of having three groups of friction elements, it has five such groups.

Figure 9:
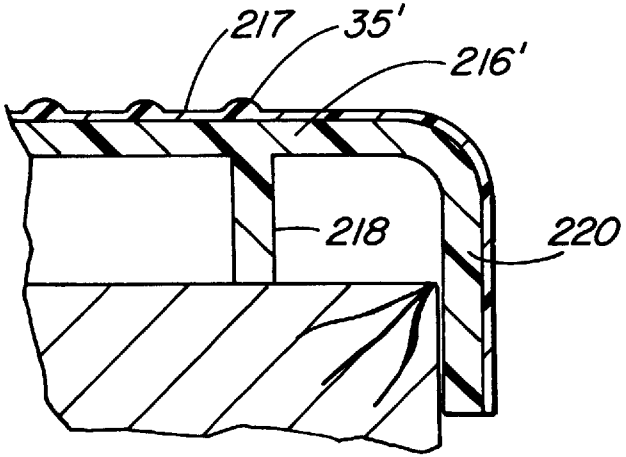
FIG. 9 which appears on the same drawing sheet as FIG. 1, is a fragmentary view of an end portion of the plank cover.
Figure 2:
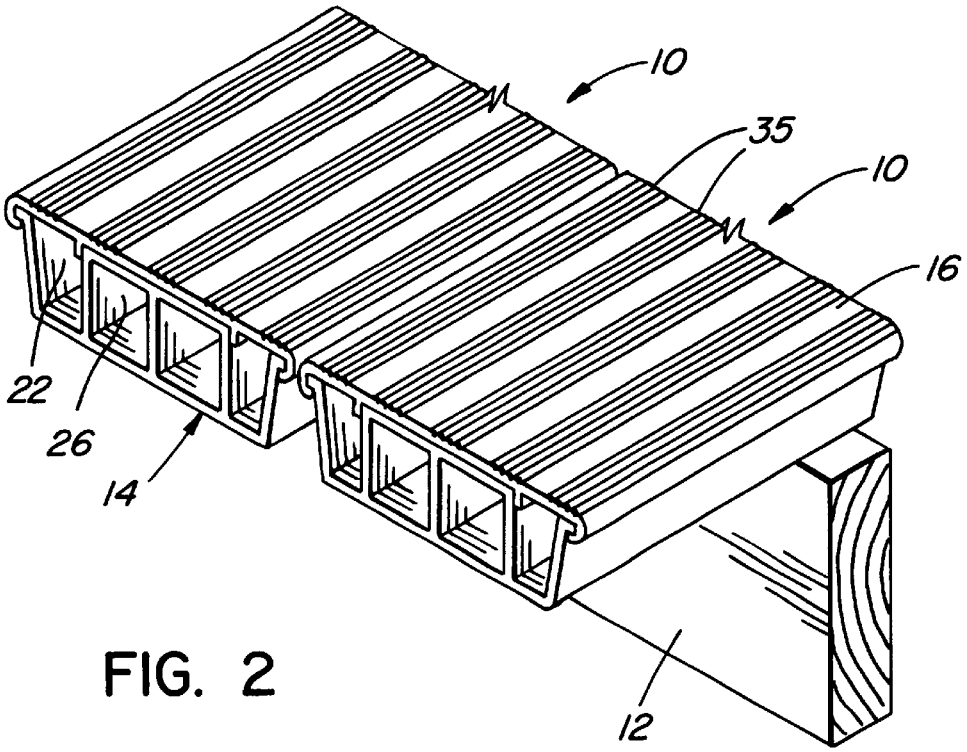
FIG. 2 is a perspective view of the ends of the two members.

FIG. 9 shows an edge portion of a plank cover similar to that of FIGS. 7 or 8 but which has been modified to include a capstock 217 integral with the ribs 35' and co-extruded with the main component 216'. The capstock 217 is of the same relatively soft material as the ribs, this material being chosen so that, although soft, it is wear resistant. This arrangement provides a construction in which the ribs, while embedded in the top plate (which includes the capstock layer), do not weaken the main component 216'.

We claim:

1. An elongated member suitable for use as a cover for flooring, decking, or seating, comprising top plate means overlaying spacer means suitable for spacing the top plate means above a top surface of a flat support, said spacer means providing said member with an underside suitable for resting in stable manner on said flat support, said top plate means bridging gaps between said spacer means, both the top plate means and spacer means being extruded from plastics material;

wherein said top plate means includes a main component and, protruding upwardly therefrom, ribs constituted by portions of parallel, spaced apart, elongated friction elements co-extruded with said main component, said friction elements being formed of plastic having distinctly greater softness or flexibility than that of said main component which lies between and underneath said friction elements, said friction elements having a hardness of between 50 and 92 Durometer on the Shore A scale and being suitable for providing a non-slip surface;

and wherein said friction elements have lower portions embedded in the top plate means but do not penetrate more than one half the top plate depth.

2. An elongated member according to claim 1, wherein the friction elements have a hardness less than 90 Durometer on the Shore A scale.

3. An elongated member according to claim 1, wherein the friction elements have a hardness less than 80 Durometer on the Shore A scale.

4. An elongated member according to claim 1, wherein the friction elements have a hardness of between 75 and 85 Durometer on the Shore A scale.

5. An elongated member according to claim 1, wherein said main component of the top plate means has a hardness of at least 70 Durometer on the Shore D scale.

6. An elongated member according to claim 1, wherein said friction elements are rods.

7. An elongated member according to claim 1, wherein the spacer means are integrally extruded with the top plate means, whereby the member is produced by extrusion in a single step.

8. An elongated member according to claim 7, wherein the spacer means includes two upwardly open spaced-apart channels having bottom webs suitable for lying on the flat support top surface and for receiving fasteners to secure the member to said surface, and wherein the member also includes end flanges which overlie sides of said support.

9. An elongated member according to claim 8, wherein the spacer means includes ribs protruding downwardly from the top plate means, said ribs having bottom surfaces which are co-planar with the bottom surfaces of said channels.

10. An elongated member according to claim 7, wherein the spacer means includes ribs protruding downwardly from the top plate means.

11. An elongated member according to claim 8, wherein said friction elements are integral with a capstock layer overlying said main component of the top plate means.

12. An elongated member according to claim 7, wherein said friction elements are integral with a capstock layer overlying said main component of the top plate means.

* * * * *